US005364088A

United States Patent [19]

Maruyama et al.

[11] Patent Number: 5,364,088

[45] Date of Patent: Nov. 15, 1994

[54] PAPER HOLDING APPARATUS

[75] Inventors: Hiroyoshi Maruyama, Yokohama, Japan; Luigi Dantonia, Grange Di Front; Felice Giacometto, Caluso, both of Italy

[73] Assignees: Olivetti-Canon Industriale S.p.A., Ivrea, Italy; Canon Kabushiki Kaisha, Tokyo, Japan

[21] Appl. No.: 10,758

[22] Filed: Jan. 29, 1993

[30] Foreign Application Priority Data

Jan. 30, 1992 [IT] Italy ..... TO92A000068

[51] Int. Cl.[5] ..... B65H 1/22

[52] U.S. Cl. ..... 271/164; 271/162

[58] Field of Search ..... 271/145, 162, 164; 312/9.47, 9.48, 9.57, 9.22, 319.1, 333; 221/154, 197

[56] References Cited

U.S. PATENT DOCUMENTS 5,139,252 8/1992 Morita et al. ..... 271/162 X 5,156,388 10/1992 Morita ..... 271/164 X

*Primary Examiner*—Robert P. Olszewski

*Assistant Examiner*—Carol L. Druzbick

*Attorney, Agent, or Firm*—Banner, Birch, McKie & Beckett

[57] ABSTRACT

A paper tray for a photocopier comprises a container (1) which can travel between open (E) and closed (L) positions. It moves along guides (22, 24). A drive mechanism (32) move the container from the closed to the open position by exerting a constant force on the container. The container is mounted on a carriage (20). This is supported by a pair of transport rollers (28) which roll along the guides. The rollers (28) are firmly connected together for rotation by a shaft (30).

A locking mechanism is provided for the container. A lever (54) is rotatable on the photocopier to lock the container in the closed position. The lever is coupled to a slide (60) having a cam groove (65) therein. This is arranged to move a locking element (55) which engages the lever (54) so as to release the lever (54) as the container is pushed further into the photocopier in the closed position.

23 Claims, 8 Drawing Sheets

PAPER HOLDING APPARATUS

Field of the Invention

The present invention relates to a paper tray or cassette for use in a photocopier or similar office machine, comprising a container which is movable relative to the photocopier, along a plurality of guides attached to the copier and drive means to move the container from a closed first position to an open second position.

The paper tray, or cassette as it will be referred to from now on, according to the present invention may be employed not only in photocopiers, but also for example in printers and other applications which require the use of paper in precut sheets.

BACKGROUND OF THE INVENTION

Various systems are known in the art for opening a cassette in a photocopier in order to insert new sheets.

In the simplest case, the user removes the cassette from the machine manually. In this case, a space is needed next to the machine on which to place the cassette.

In another case, the user manually pulls the cassette out far enough to be able to insert new sheets. The cassette remains connected to the machine. One drawback of this solution is that stops could be broken by the user if his movements are too jerky during the last section of travel of the cassette.

In these two prior art examples manual operation is required on the part of user. This may lead to problems resulting from the care with which the user acts. Pulling the cassette out too quickly with consequent shifting of the paper in the cassette can cause damage during operation. There is also the risk of the cassette falling on the floor and operational parts being broken, or of incorrect positioning of parts that need to be positioned accurately. Another drawback to these systems is that the stops for the cassette can get broken during the last section of travel inwardly or outwardly (in particular in the 2nd case), thus causing the cassette to fall to the floor. Another not insignificant drawback occurs if the user has not pulled the cassette out completely, that is far enough to be able to load the paper, so that he will realise this only when his hands are already full with the paper he wants to load into the machine, and he will therefore have to put the paper down again and pull the cassette out completely, thereby wasting time.

In yet another case, the cassette is firmly inserted in the machine in the working position and projects outwardly sufficiently far enough to allow sheets of paper to be inserted after opening of a lid of the cassette. With such an arrangement the cassette is always projecting outwardly from the machine and thus more space is required to accommodate the machine.

SUMMARY OF THE INVENTION

Preferred embodiments of the present invention provide a paper tray or cassette which opens automatically and does not have the drawback listed above. In particular, the cassette is able to prevent the paper from shifting within it, incorrect positioning of any parts that need to be accurately positioned breakage of the stop parts, and drawbacks owing to incomplete or too hurried an opening of the cassette.

Preferably the cassette is pulled or pushed out automatically at a controlled speed and always reaches its maximum opening location at which paper can be easily inserted into the cassette.

Preferably the cassette when in use in the machine is inserted wholly inside the machine and does not require additional table space around the machine on which to place the cassette once it has been pulled out of the machine.

The invention is defined in its various aspects in the appended claims to which reference should now be made.

BRIEF DESCRIPTION OF THE DRAWINGS

These and other features will become clearer from preferred embodiments of the invention which are now described by way of example, with reference to the appended drawings in which.

DETAILED DESCRIPTION OF PREFERRED EMBODIMENTS

Figure 1:
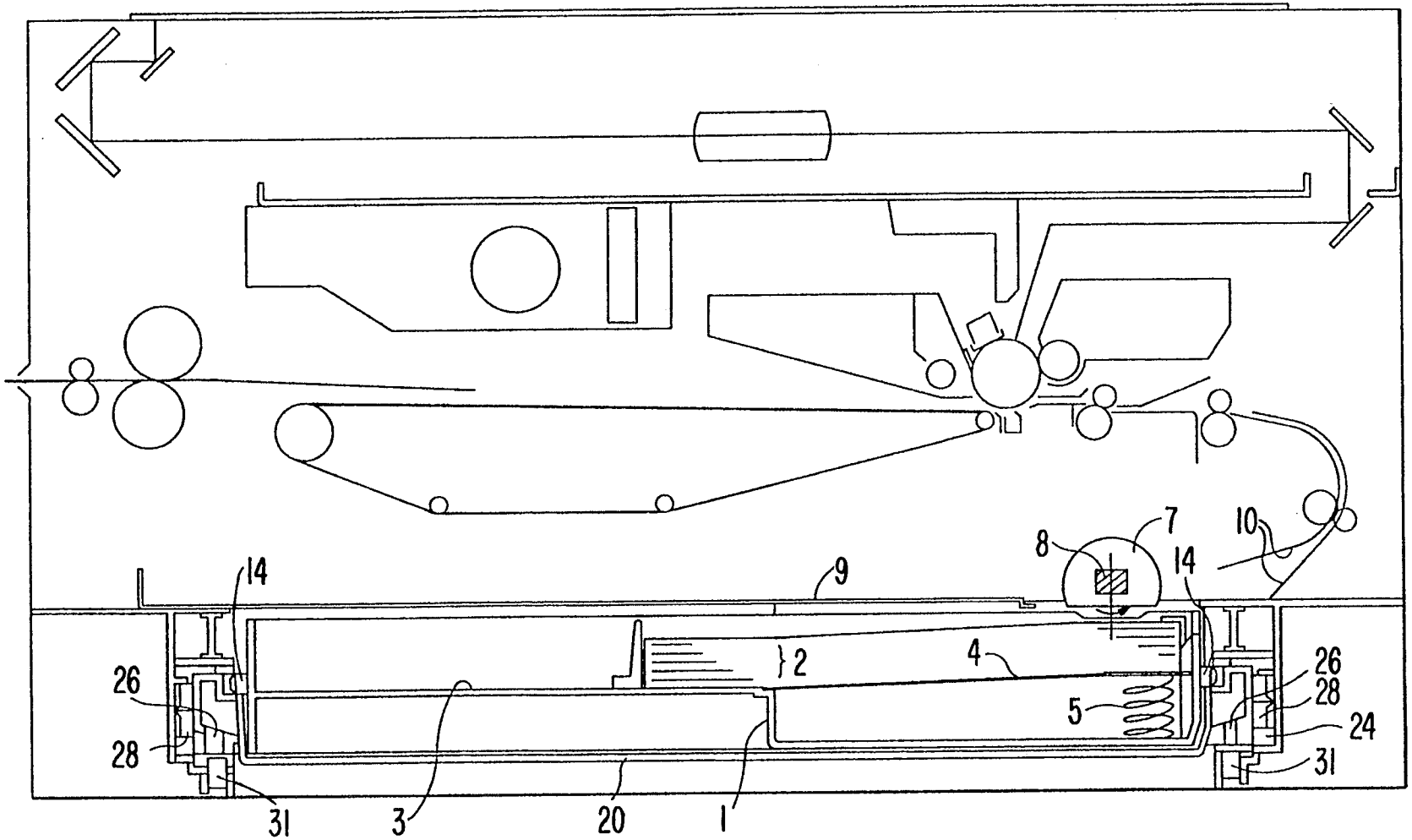
FIG. 1 is a front view of the inside of a photocopier fitted with an automatically opening paper tray or cassette embodying the invention.

FIG. 1 shows a paper cassette 1 containing a pack of sheets 2. The sheets 2 are partly placed on a shelf 3 which is stationary inside the cassette 1 and are partly supported on a vertically movable shelf 4. The shelf 4 is kept raised by a spring 5 so as to bring the top sheet 2*a* of the pack against stop tabs 6, which form part of the cassette 1.

A feed roller 7 is arranged in proximity to the tabs 6 and is mounted on a rotatable shaft 8 on the framework 9 of the photocopier.

When the feed roller 7 is turned in an anticlockwise direction, the top first sheet 2*a* is pushed in a known manner inside the photocopier along guides 10.

The other components shown in FIG. 1 and their operation will not be discussed in the following description since they are not relevant to the present invention.

On each of the side walls 11 and 12 of the cassette 1 (FIGS. 2 and 4) are attached two pins 13 and 14 which project outwards and can engage in two corresponding open slots 15 and 16 formed in the side walls 17 and 18 of a carriage 20 which supports the cassette 1.

The slots 15 and 16 are shaped so that the cassette is supported in a cantilevered manner between the pins and slots on the carriage 20 (FIG. 7) when the cassette 1 is completely outside the machine.

In order to remove the cassette 1 from the carriage 20, firstly the outermost end A (FIG. 7) of the cassette 1 is lifted up to remove the pins 13 from the slots 15 and the cassette is then pulled horizontally so as to release the pins 14 from the slots 16.

The carriage 20 (FIGS. 3 and 4) is slideable along parallel guides 22 and 24 formed on the sides of the photocopier (FIG. 1), by means of rollers 26 and 28.

The rollers 26 (FIG. 4) are independently rotatable and are carried on arms 27 at the internal end of the carriage 20. These roll along the guides 22.

The rollers 28 also can rotate on the carriage 20 on which they are carried and are firmly connected together for rotation by a shaft 30.

Figure 2:
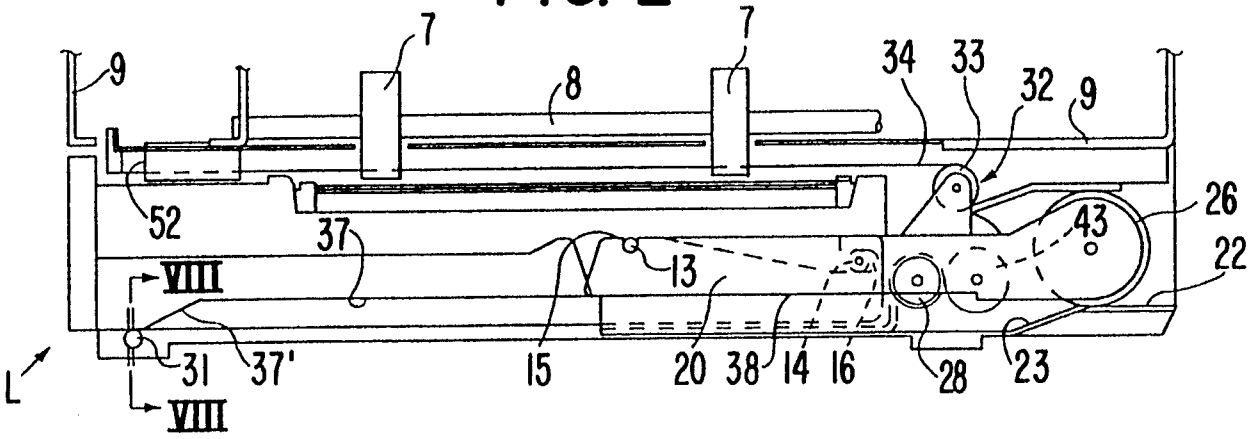
FIG. 2 is a lateral view of the cassette shown in FIG. 1, in the working position.
Figure 3:
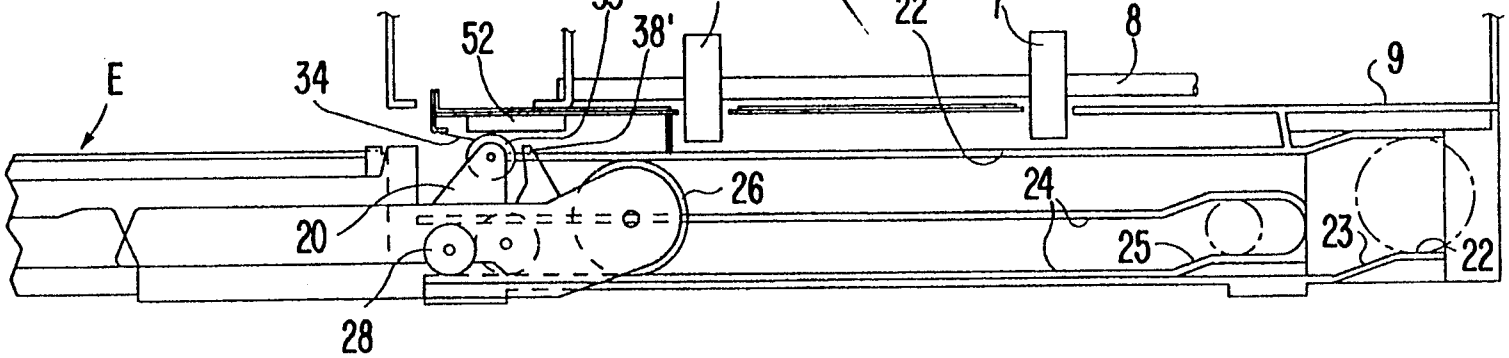
FIG. 3 is a lateral view of the cassette shown in FIG. 1, in the open position.

The rollers 28 roll along the guides 24 of the machine (FIG. 3). The guides 22 and 24 each comprise a pair of guides, lower guides 22' and 24' and upper guides 22'' and 24'' respectively. In particular, the upper guide 22'' prevents the carriage 20 from rocking, i.e. from oscillating in a vertical plane by turning about a horizontal axis perpendicular to the direction of said guides. In the case of specific constructional requirements, the lower guides 22' and 24' may be one and the same, forming a single guide of suitable width. A motor 32 is arranged on the carriage 20 and is used to automatically move the cassette carriage unit from a working position L shown in FIG. 2 to an external position E, shown in FIG. 3.

The motor 32 (FIGS. 2 and 4) comprises a pulley which is carried by and rotates on the carriage 20.

A spiral spring 34 is wound round the pulley 33. This spring is formed from a preshaped strip of spring steel. It has one end fixed to an attachment point 36 of the photocopier and the other end fixed to the pulley 33.

When the cassette is inserted wholly inside the machine, the spring 34 is extended (FIG. 2) and stressed and therefore tends to wind itself around the pulley 33, so that the cassette carriage 20 unit is urged with a constant force towards the position E (FIG. 3) in which it is stopped by a stop 38.

In order to avoid excessive acceleration of the carriage as a result of the constant force exerted by the spring 34, the carriage 20 is provided with a speed limiting device.

The device comprises a hydraulic type of brake 42, known in the art, although any other type of brake can be used.

The brake 42 comprises a flywheel, not shown, which is immersed in a viscous liquid and made to turn by the shaft 30 (FIG. 4), by means of gears 43 and 44 which are carried by and are rotatable on the carriage 20. As a result of this its braking action is proportional to the speed of the carriage.

Figure 4:
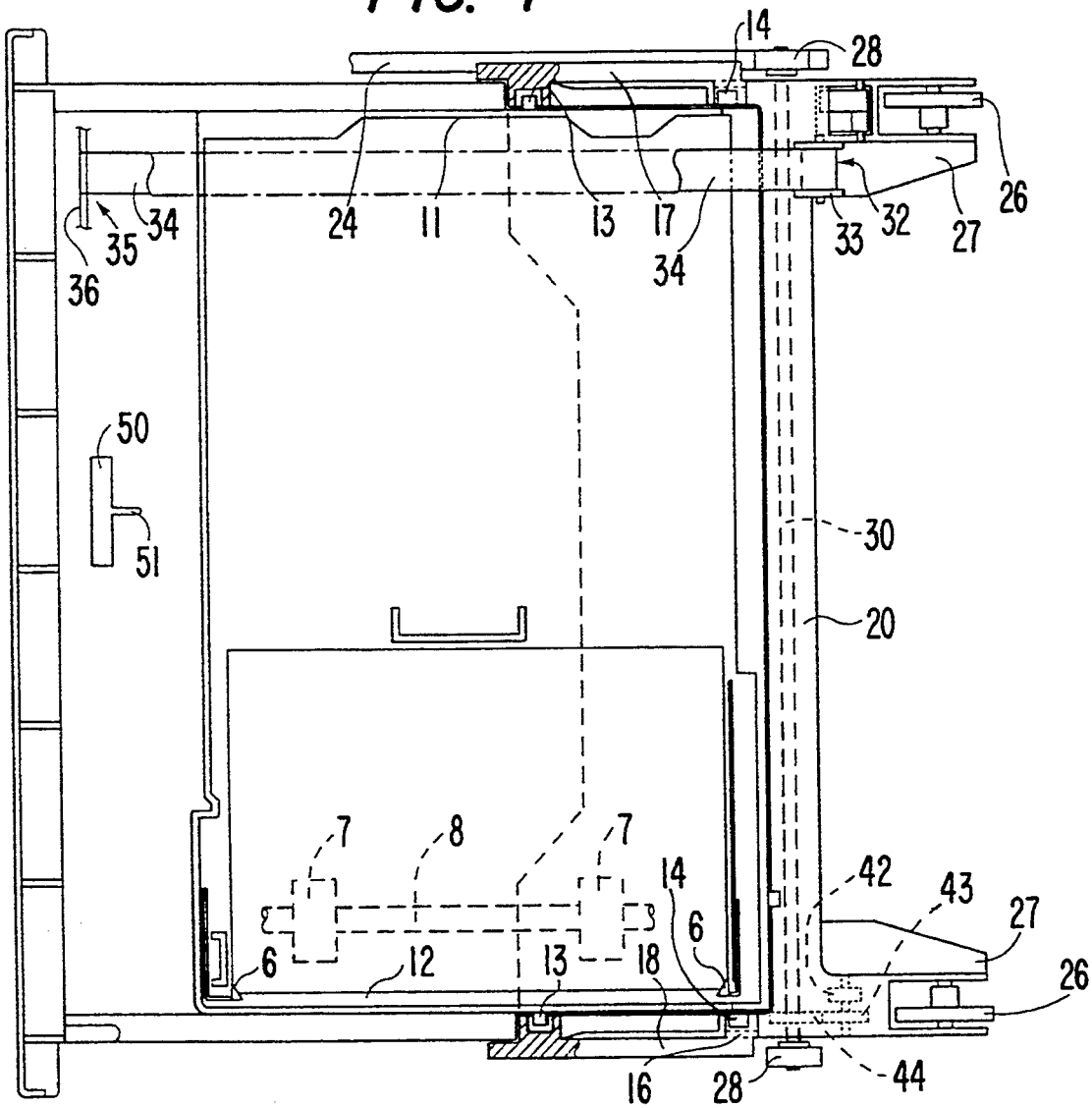
FIG. 4 is a plan view of the drawer shown in FIG. 2.
Figure 7:
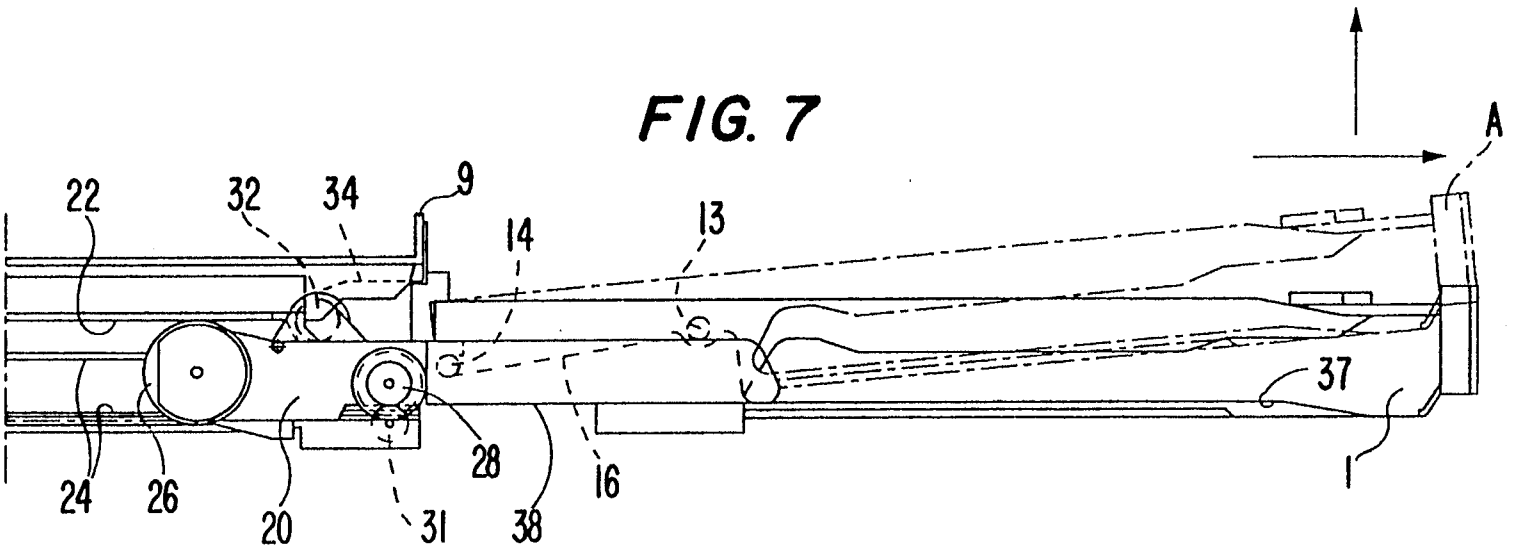
FIG. 7 is a diagram showing the cassette/carriage mounting system.

There is a T-shaped projection 50 on the drawer 1 in its upper front part (FIGS. 4 and 7).

The projection has a dual function: 1) it stops the cassette inside the machine in its working position; 2)it controls a mechanism 52 for preventing the opening of the cassette (FIG. 5, FIG. 6) in its working position.

The locking and opening mechanism 52 is fixed onto the framework of the machine and is made up of a lever 54 and a hook 55, rotatable about pins 53 and 56 respectively. The lever 54 is constantly pulled by a spring 57 in a clockwise direction. A slide 60 coupled via a second spring 64 to the lever 54. The second spring 64 urges the lever 54 in an anticlockwise direction.

On the upper surface of the slide 60 there is a cam groove 65 having branches inside which slides a pin 67 which is integral with a lever 68. This permits the lever 68 to turn about a pivot 56, guided by the groove 65 as the slide moves.

When the cassette 1 is locked inside the machine as shown in FIG. 2, the lever 54 locked over the projection 50, the lever 54 being held in position by the hook 55.

When the cassette is to be released, the following procedure is carried out:

the cassette is pushed further into the machine so that the tip 51 of the projection 50 pushes an abutment 61 which is integral with the slide 60 thereby moving the groove 65.

Figure 5:
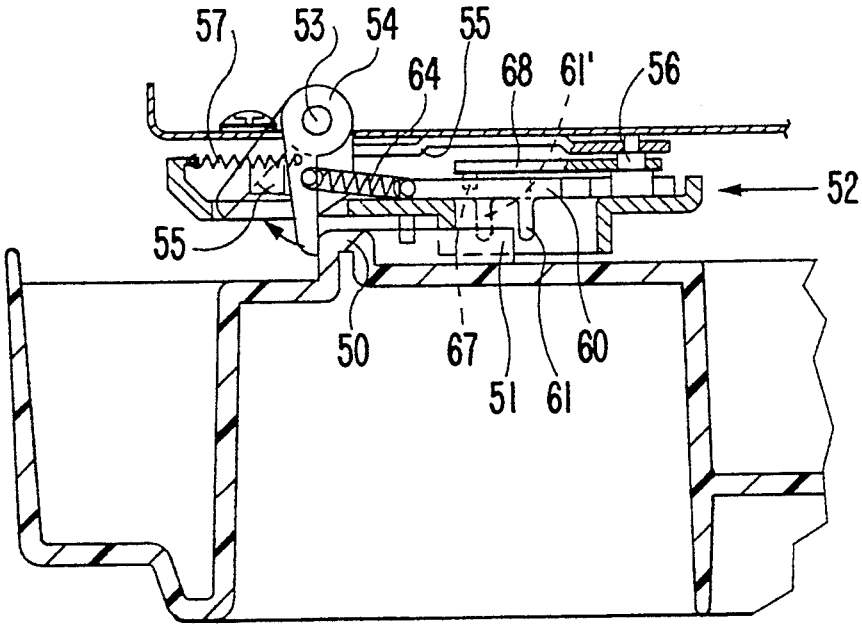
FIG. 5 is a lateral view of a cassette release mechanism.
Figure 6:
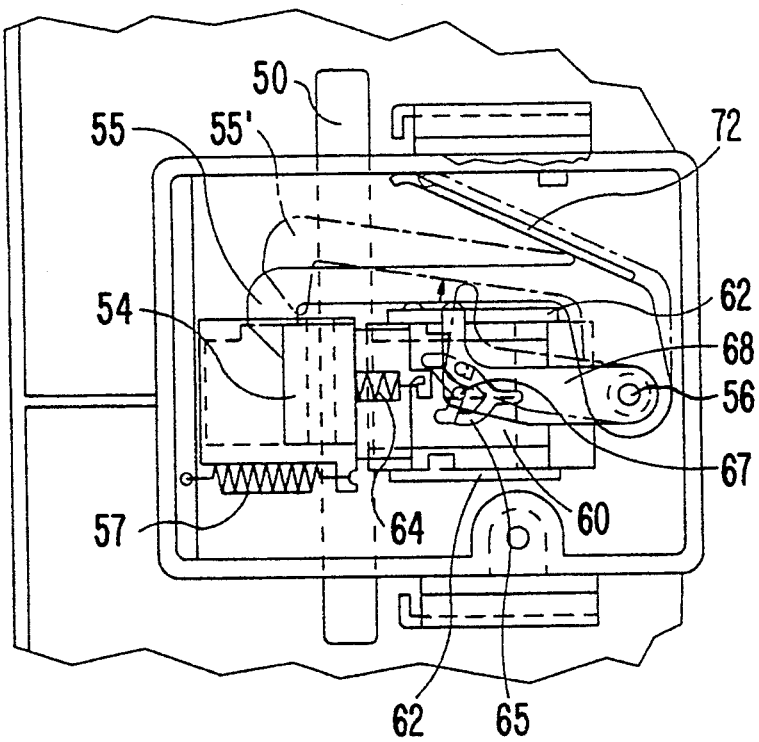
FIG. 6 is a plan view of the mechanism shown in FIG. 5.
Figure 6A:
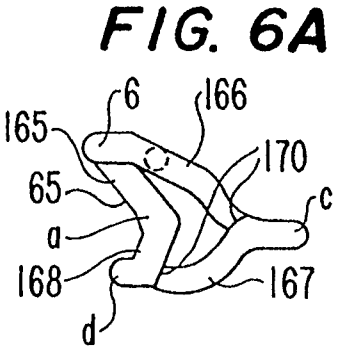
FIG. 6A is a detail of FIG. 5.

The pin 67, which firstly is in a position "a" (FIG. 6A), is displaced into a position "b", following a track 165 of the groove 65, so as to rotate the lever 68 in a clockwise direction (FIG. 6). The lever 68 contacts and pushes the hook 55 towards the position 55' so as to release the lever 54, which is rotated by a spring 57 in a clockwise direction F (FIG. 5) away from the stop 50 and frees the way for the cassette 1 to move outwardly. The lever 54 causes the slide 60 to slide by means of a spring 64 toward the lever 54 (position 61' of the abutment 61), so that the pin 67 is guided towards a new position "c" (FIG. 6A) along a track 166 of the groove 65.

When the cassette 1 is again pushed into the machine, the tip 51 of the stop 50 pushes to the right the abutment 61 (FIG. 5). The slide 60 then moves the pin 67 from the position "c" (FIG. 6A) towards a position "d" along a track 167 of the groove 65 and finally the pin 67 reaches the position "a" along a track 168, due to the effect of the spring 64, which slightly moves the slide 60 to the left in FIG. 5. The travel of the pin 67 from the position "a" to the position "d" and again to "a" is permitted in that the bottom surface of each track 165, 166, 167 is inclined and each track is separated from the next one by a little step 170 (FIG. 6A) which prevent the pin 67 from moving back in the same track.

In order to always keep the cassette/carriage unit parallel to itself and to support it when it projects fully out of the photocopier, the cassette is supported in the front part (towards the outside of the machine) by a pair of rollers 31 (FIGS. 1, 2, 7 and 8), which are idly mounted onto the framework 9 of the photocopier at the outer end of the guide 24.

Figure 8:
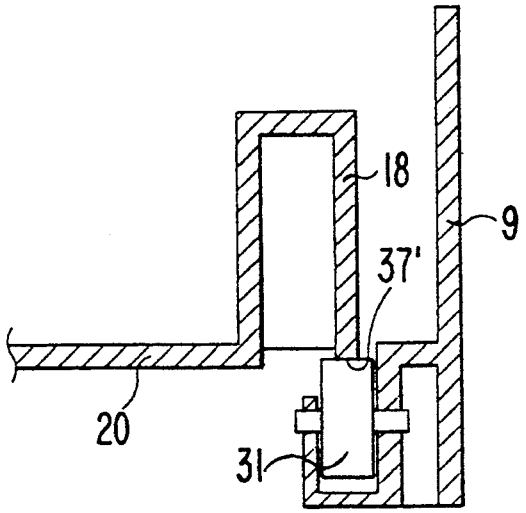
FIG. 8 is a cross-section along VIII—VIII in FIG. 2.

The rollers 31 interact with a pair of guides 37 (FIG. 2) which are integral with the cassette 1 and are aligned to follow on from the two corresponding guides 38 formed on the sides 17, 18 of the carriage 20 (FIG. 8).

To avoid interference between the cassette 1 and the feed roller 7 (FIGS. 1 and 2), whilst the cassette 1 is being inserted and pulled out, the cassette 1 is kept at a lower level when being inserted relative to the higher level it occupies in the wording position L.

For this purpose, the guides 22 and 24 have ramps 23 and 25 (FIG. 3) respectively at their inner ends.

The guides 37 also have a ramp 37' (FIG. 2) which is inclined at the same angle and is of the same length as the ramps 23 and 25, so that, when the respective rollers 31, 26, 28 travel along them, the cassette is lifted up parallel to itself and to the shaft 8, to then be stopped in the working position L at the correct distance from the feed roller.

If the cassette is to be replaced or loaded with paper, it has to be first pushed towards the inside of the machine so as to obtain the release of the locking and opening unit 52.

In this way, the carriage/cassette unit will be pulled outwards by the spring 34 and will continue to move outwards, causing the wheels 28 to rotate which, via the through shaft 30 and the gear wheels 43 and 44, cause the brake 42 to turn.

Rotation of the brake generates a force which opposes the force of the spring 34, damping the speed of movement of the carriage/cassette unit towards the outside and thus preventing it from crashing into the end-of-travel stops.

So that the surface of the roller 28 has a high degree of friction on the guides 24 in order to be able to transfer the damping force of the brake, said surface is covered with rubber having a high friction co-efficient. When the carriage/cassette unit reaches the end of its travel, the stop 38 strikes the wall 39 on the framework 9, preventing any further movement of the carriage (see FIG. 2).

Paper-loading and cassette changing operations may be carried out when the carriage/cassette unit is in this position.

In order to reposition the cassette in the working position, all that needs to be done is to push it from the front back inside the machine; locking will take place automatically via the locking and opening mechanism 52.

The force needed to push back the cassette has been established experimentally at approximately 800–1000 g. This is a preferred range.

The force needed to overcome the spiral spring 34, which in any case can be considered not excessive for the user, has been set at this value because if it were too low, this could lead to the user pushing the drawer back into the machine too violently, thereby causing damage.

Figure 9:
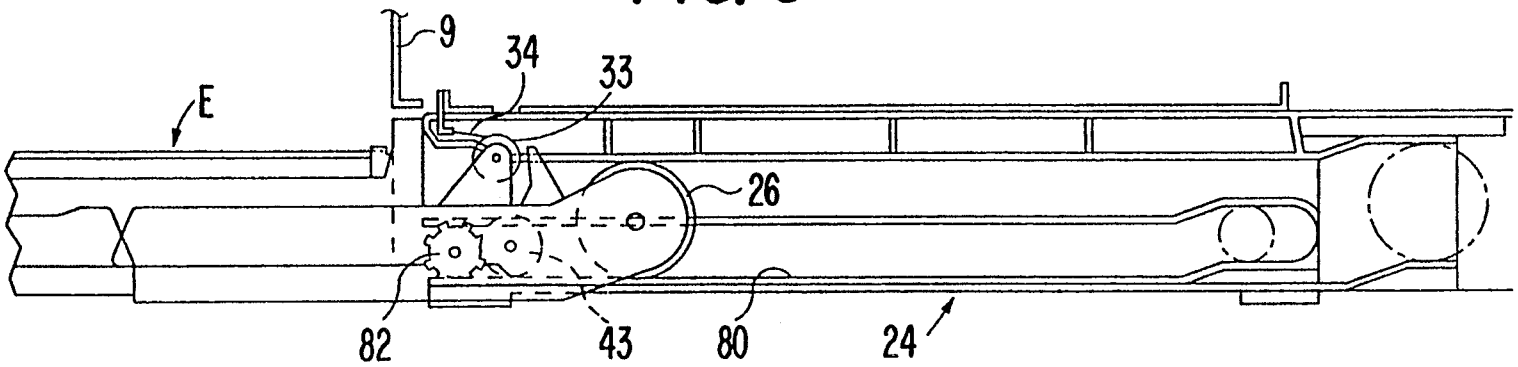
FIG. 9 is a first variant of the slide guides shown in FIG. 2.
Figure 10:
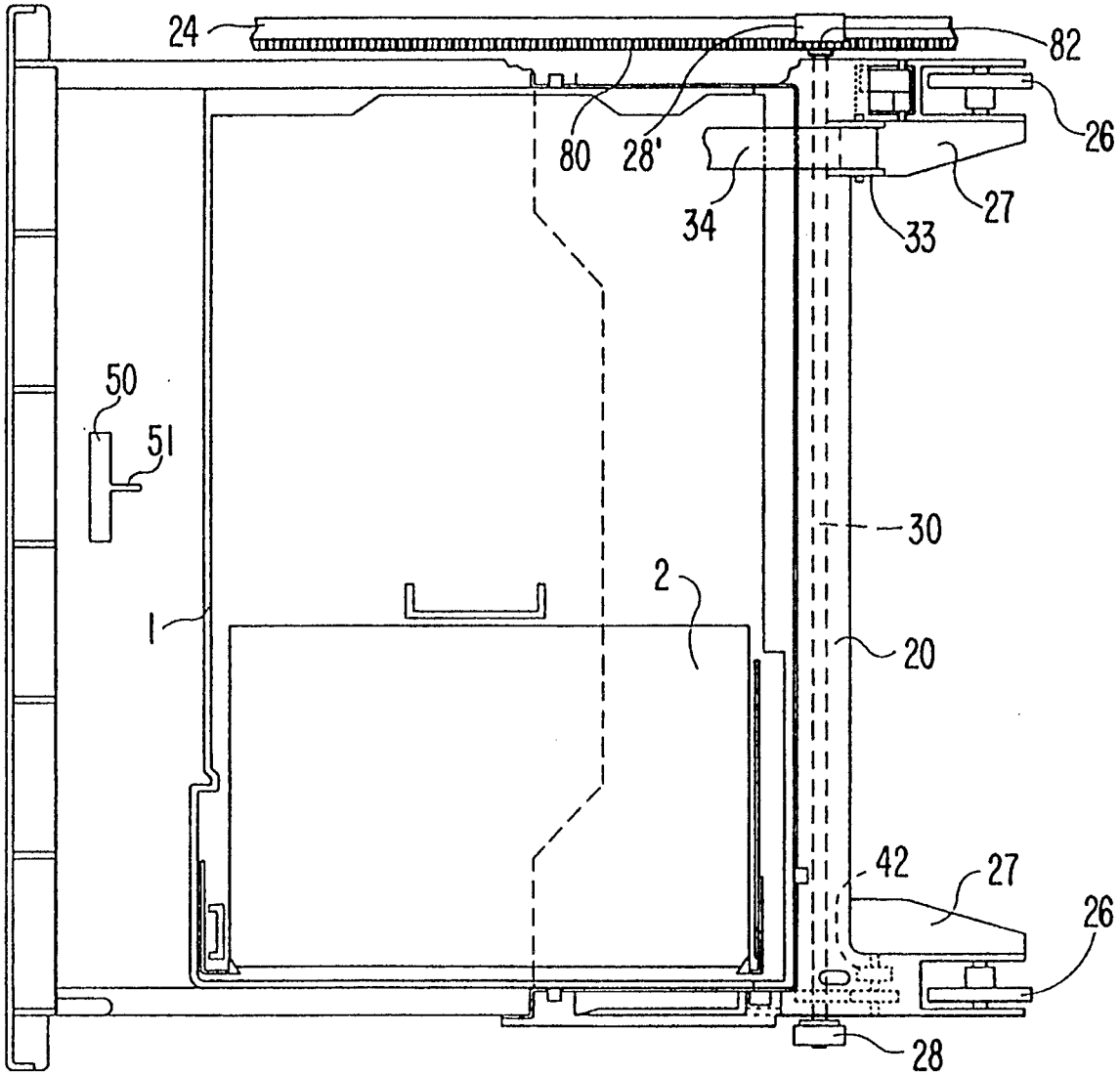
FIG. 10 is a plan view of FIG. 9.

FIGS. 9 and 10 show a variant of the system of movement of the drawer 1.

In this a rack 80 is arranged on one of the guides 24 of length corresponding to the required travel, with a toothed wheel 82 on the corresponding axle of the wheel 28' which meshes with the rack 80. This variant can improve the transfer of motion to the brake which will take place via the wheel 82 and rack, and not solely through the friction between the rubber on the wheel 28' and the guide 24 as in the previous system.

Figure 11:
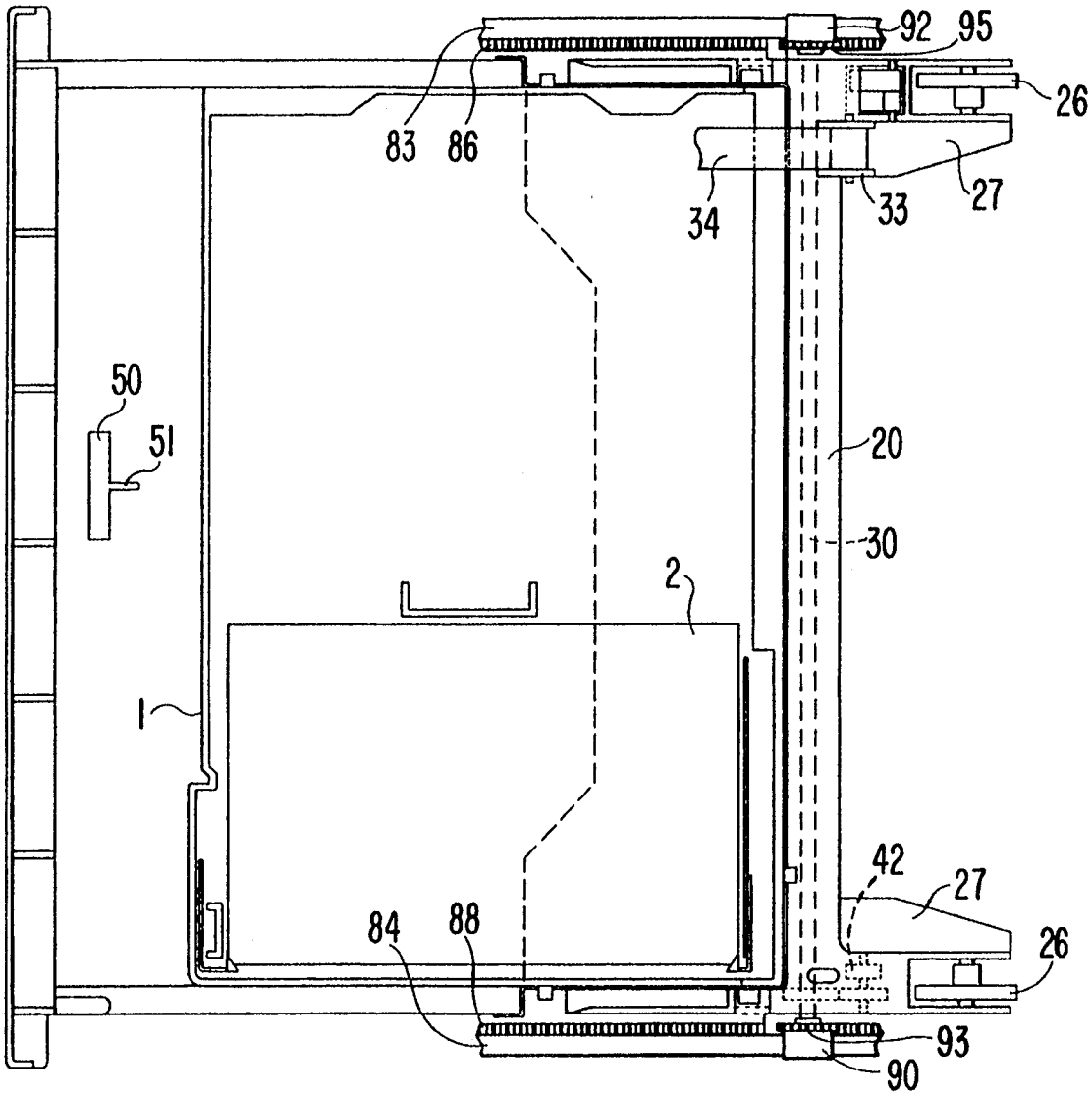
FIG. 11 is a variant of FIG. 10.

FIG. 11 shows another possible variant of the system. It is possible to place a rack 86 and 88 on each of the guides 83 and 84 and to add two toothed wheels 93 and 95 onto the roller 90 and 92. In this way the rubber covering for the wheel 28 of FIG. 2 may be omitted.

This alternative variant ensures that the cassette moves strictly in a straight line, without jamming even when the cassette is pushed in an off-centre position by the user.

Figure 12:
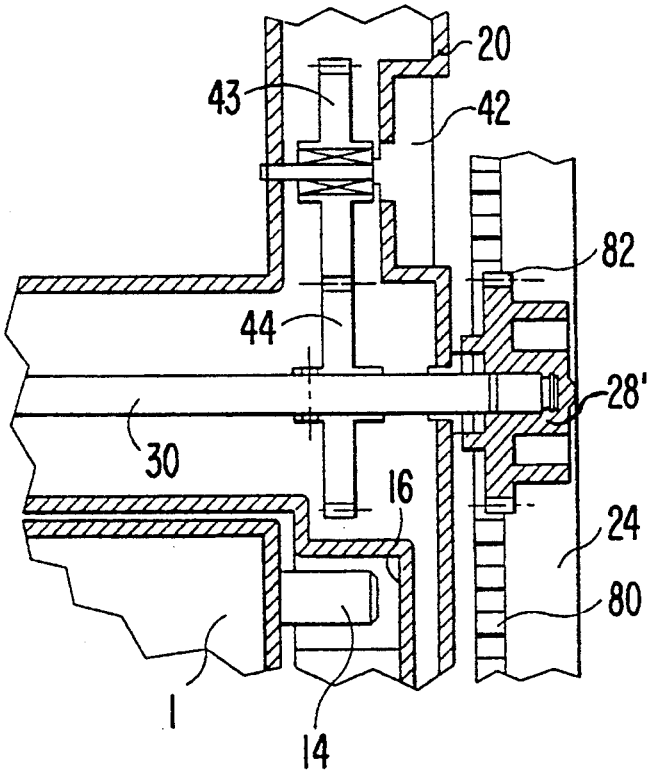
FIG. 12 is a variant of the brake shown in FIG. 4.

FIG. 12 shows a third variant of the system. The aim of this variant is to increase the ease with which the drawer is inserted inside the photocopier.

This improvement is produced by interposing a unidirectional clutch 85 (FIG. 12) between the toothed wheel (FIG. 4) and the brake 42 so that, as the cassette moves from the external position E to the working position L, the brake 42 does not act to slow down the speed of travel of the cassette.

There is no risk of the cassette crashing into anything at the end of its travel since the user has to overcome the resistance of the spring 34 which, as has already been stated, is about 800 to 1000 g.

The device for automatically opening the cassette according to the invention means that the working space required around the machine is reduced, and it is therefore applicable to compact machines for small spaces.

By introducing rack guides, ease of operation can be improved since the user does not have to push on the middle of the cassette in order to insert it without it jamming.

With the unidirectional clutch it is possible to increase the ease with which the cassette is inserted even further.

We claim:

1. A paper holding apparatus for use in an office machine, comprising:

a container for a plurality of sheets of paper;

a plurality of guides mounted on said machine, along which said container is movable relative to the machine, between a first closed position and a second open position; and drive means to move said container at a predetermined speed from said first position to said second position;

wherein said drive means exert a substantially constant force on said container in a direction parallel to the guides, as said container moves between said first and said second positions.

2. A paper holding apparatus according to claim 1, wherein the drive means comprises:

a pulley, a spiral spring wound round the pulley and fixed between the holding apparatus and the photocopier.

3. A paper holding apparatus according to claim 1 or 2, comprising:

a carriage which supports the container;

two transport rollers which roll along a first pair of the guides; and, a shaft rotatable on said carriage and firmly connecting together the transport rollers.

4. A paper holding apparatus according to claim 3 wherein the carriage comprises:

a further two idly rotatable rollers; and, a second pair of the guides along which the further two rollers roll whereby the carriage is prevented from rotating around a horizontal axis perpendicular to said direction.

5. A paper holding apparatus according to claim 4, wherein each of the pairs of guides comprises an upper guide and a lower guide with respect to the transport rollers and to the further two rollers respectively.

6. A paper holding apparatus according to claim 5, wherein each of the pairs of guides have a common lower guide.

7. A paper holding apparatus according to claim 5, wherein at least one of the upper guides interacts with one of the idly rotatable rollers so as to prevent said carriage from oscillating about a horizontal axis perpendicular to the guides.

8. A paper holding apparatus according to claim 3, wherein at least one of the transport rollers is covered with rubber.

9. A paper holding apparatus according to claim 3, wherein one guide of the first pair is flanked by a rack and at least one of the tranport rollers comprises a toothed ring which meshes with the rack.

10. A paper holding apparatus according to claim 1, wherein the guides of said plurality comprise a first section and a second shorter section which is inclined relative to the first section so as to lift up said container as the container approaches the first position.

11. A paper holding apparatus according to claim 10, wherein said guides comprise an idly rotatable auxiliary roller mounted on the first section opposite the inclined section, said auxiliary roller engaging with the container in the first position.

12. A paper holding apparatus according to claim 3, comprising a braking device which exerts a braking force on the container opposite to said constant force and proportional to said speed of the container as the container travels from the first to the second positions.

13. A paper holding apparatus according to claim 12, wherein the braking device comprises a hydraulic brake mounted on said carriage and kinematically connected to the rotatable shaft.

14. A paper holding apparatus according to claim 13, comprising a unidirectional clutch interposed between the rotatable shaft and the hydraulic brake to cancel out the braking force as the container travels from the second to the first position.

15. A paper holding apparatus for use in a photocopier, comprising:

a first pair of parallel guides mounted on said photocopier;

a carriage movable along said first pair of guides between a first position and a second position and carrying a container for paper sheets;

a pair of transport rollers to support said carriage in rolling relation with said first pair of guides;

a shaft rotatably mounted on said carriage and firmly connecting said transport rollers together, to guide said container in a direction parallel to said guides, without lateral jamming;

a second pair of guides mounted on said photocopier and parallel to the guides of said first pair;

a second pair of idly rotatable rollers, mounted on said carriage and rolling on said second pair of guides, wherein each of said first and second pairs of guides comprises an upper guide and a lower guide, with respect to said transport roller and to said idly rotatable roller respectively, whereby said carriage is prevented from rotating around an axis perpendicular to said direction.

16. A paper holding apparatus according to claim 15, wherein each of the pairs of guides have a common lower guide.

17. A paper holding apparatus according to claim 15, wherein one of the transport rollers is covered with rubber.

18. A paper holding apparatus for a photocopier, comprising:

a first pair of parallel guides mounted on said photocopier;

a carriage movable along said first pair of guides between a first position and a second position and carrying a container for paper sheets;

a first pair of transport rollers to support said carriage in rolling relation with said first pair of guides;

a shaft rotatably mounted on said carriage and firmly connecting said transport rollers together, to guide said container in a direction parallel to said guides, without lateral jamming;

a second pair of guides mounted on said photocopier and parallel to the guides of said first pair;

a second pair of idly rotatable rollers, mounted on said carriage and rolling on said second pair of guides to prevent said carriage from rotating around an axis perpendicular to said direction;

wherein one guide of said first pair is flanked by a rack and at least one of the transport rollers comprises a toothed ring which meshes with the rack, to prevent said at least one transport roller from sliding on said one guide.

19. A paper holding apparatus for a photocopier, comprising:

guide means mounted on said photocopier;

a carriage carrying a container for paper sheets, said carriage being movable by a constant force and at a predetermined speed along said guide means between a first position in which said carriage is introduced into said photocopier, and a second position in which said carriage is positioned out of the photocopier;

a first pair of transport rollers to support said carriage in rolling relation with said guides;

a shaft rotatably mounted on said carriage and firmly connecting said transport rollers together, to guide said container in a direction parallel to said guides, without lateral jamming;

a braking device which exerts a braking force on said carriage opposite to said constant force and proportional to said speed, as said carriage travels from said first position to said second position, whereby the speed of movement of the carriage is dampened until said second position is reached by the carriage.

20. A paper holding apparatus according to claim 19, wherein the braking device comprises a hydraulic brake mounted on said carriage and kinematically connected to the rotatable shaft.

21. A paper holding apparatus according to claim 20, comprising a unidirectional clutch interposed between the rotatable shaft and the hydraulic brake to cancel out the braking force as the container travels from the second to the first position.

22. A paper holding apparatus for a photocopier, comprising:

guide means mounted on said photocopier;

a carriage carrying a container for paper sheets, said carriage being movable along said guide means between a first position in which said carriage is introduced into said photocopier, and a second position in which said carriage is positioned out of the photocopier;

a first pair of transport rollers to support said carriage in rolling relation with said guides;

a shaft rotatably mounted on said carriage and firmly connecting said transport rollers together, to guide said container in a direction parallel to said guides, without lateral jamming;

a lever rotatable on the photocopier in order to keep said container in said first position;

a slide carrying a cam groove thereon and moved by said carriage with respect to said rotatable lever;

a locking element engageable with said rotatable lever and controlled by said cam groove to release said rotatable lever when the container is pushed further from said first position into said photocopier.

23. A paper holding apparatus, according to claim 22, wherein said locking element comprises a cam follower which engages in said groove, said groove comprising a first branch along which the locking element remains engaged on the rotatable lever, and a second branch along which the locking element releases said rotatable lever.

* * * * *